US011268682B1

(12) United States Patent
Sun

(10) Patent No.: US 11,268,682 B1
(45) Date of Patent: Mar. 8, 2022

(54) SAFETY INDUCTION LAMP SUPPLIED WITH POWER BY DRY CELLS AND LITHIUM BATTERIES

(71) Applicant: Dong Guan Technomate Metal Ware Manufactory Ltd, Guang Dong (CN)

(72) Inventor: Xiaojun Sun, Guang Dong (CN)

(73) Assignee: Dong Guan Technomate Metal Ware Manufactory Ltd, Guang Dong (CN)

( * ) Notice: Subject to any disclaimer, the term of this patent is extended or adjusted under 35 U.S.C. 154(b) by 0 days.

(21) Appl. No.: 17/381,171

(22) Filed: Jul. 20, 2021

(51) Int. Cl.

| | |
|---|---|
| ***F21V 23/00*** | (2015.01) |
| ***F21S 9/03*** | (2006.01) |
| ***F21V 23/04*** | (2006.01) |
| ***F21V 23/02*** | (2006.01) |
| ***F21Y 115/10*** | (2016.01) |

(52) U.S. Cl.
CPC ..... *F21V 23/003* (2013.01); *F21S 9/035* (2013.01); *F21V 23/02* (2013.01); *F21V 23/0435* (2013.01); *F21Y 2115/10* (2016.08)

(58) Field of Classification Search
CPC .... F21V 23/003; F21V 23/02; F21V 23/0435; F21S 9/035
USPC ..... 362/183
See application file for complete search history.

(56) References Cited

U.S. PATENT DOCUMENTS

| | | | | |
|---|---|---|---|---|
| 7,654,683 | B2 * | 2/2010 | Ellis | H01M 50/24 362/158 |
| 9,624,900 | B2 * | 4/2017 | Phillips | F03B 13/20 |
| 2012/0201016 | A1 * | 8/2012 | Robertson | B62D 63/08 362/183 |
| 2014/0247584 | A1 * | 9/2014 | Kodama | H05B 47/11 362/183 |
| 2018/0066833 | A1 * | 3/2018 | Draaijer | F21S 8/086 |
| 2021/0239308 | A1 * | 8/2021 | Gerlings | F41C 27/00 |

* cited by examiner

*Primary Examiner* — Bryon T Gyllstrom
(74) *Attorney, Agent, or Firm* — JCIP Global Inc.

(57) ABSTRACT

The invention relates to the technical field of illuminating lamps, in particular to a safety induction lamp supplied with power by dry cells and lithium batteries. The safety induction lamp comprises a mount, a connecting bracket assembly, a PCBA, a lamp base assembly, an induction head assembly, a battery box assembly and a photovoltaic solar panel assembly. The battery box assembly is provided with dry cells and rechargeable batteries. The PCBA controls the rechargeable batteries or the dry cells to supply power to the lamp base assembly.

10 Claims, 3 Drawing Sheets

SAFETY INDUCTION LAMP SUPPLIED WITH POWER BY DRY CELLS AND LITHIUM BATTERIES

BACKGROUND

Technical Field

The invention relates to the technical fields of illuminating lamps, in particular to a safety induction lamp supplied with power by dry cells and lithium batteries.

Description of Related Art

Safety induction lamps, as safety lamps, are common used in residences, courtyards and commercial environments. Such a safety illuminating system is able to illuminate a large dark area when a human or moving heat source approaching the system is detected by a motion sensor, thus bringing convenience to user's life and realizing safety warning.

However, most existing low-voltage safety illuminating lamps use rechargeable batteries as the unique power supply system, so when the photovoltaic solar panel is in a low-illumination environment such as rainy days, it is unable to charge the rechargeable batteries, and thus, effective illumination of the safety induction lamps cannot be guaranteed.

In view of this, it is necessary to provide a safety induction lamp supplied with power by dry cells and lithium batteries to better solve the above-mentioned problems.

SUMMARY

To solve the above-mentioned problems, the invention provides a safety induction lamp supplied with power by dry cells and lithium batteries, which is simple in structure, reasonable in design and convenient to use.

The technical solution adopted by the invention is as follows.

A safety induction lamp supplied with power by dry cells and lithium batteries comprises a mount, a connecting bracket assembly, a PCBA, and a lamp base assembly, an induction head assembly, a battery box assembly and a photovoltaic solar panel assembly that are connected to the PCBA. The battery box assembly is provided with dry cells and rechargeable batteries. The PCBA includes a power switch module for switching the dry cells or the rechargeable batteries for power supply, an illumination control module for controlling the illumination time and illumination brightness of the lamp base assembly, an induction control module for controlling the induction distance and induction temperature of the induction head assembly, an environment temperature monitoring control module for controlling the induction head assembly to detect the environment temperature, a remote control module to be connected to an external control, a Bluetooth module for controlling the lamp by means of a mobile terminal front-end, a WIFI module for remotely controlling the lamp by means of a mobile phone APP, a link control module for link control of multiple safety induction lamps, and a control chip.

Furthermore, the safety induction lamp further comprises functional switches and functional indicators. The functional indicators and the functional switches are connected to the illumination control module and the induction control module, respectively.

Furthermore, the functional switches comprise an environmental brightness control switch, an induction distance control switch, an illumination time control switch, an illumination intensity switch and a test switch.

Furthermore, the induction head assembly is provided with a signal receiver connected to the PCBA.

Furthermore, the connecting bracket assembly comprises a connecting plate and a movable arm. The connecting plate is rotatably connected to the mount, and the movable arm has an end rotatably connected to the connecting plate and an end rotatably connected to the lamp base assembly.

Furthermore, the lamp base assembly is provided with a housing, a panel and a plurality of LED lamp beads. A connecting block is disposed at a rear end of the housing and is movably connected to the movable arm, the panel is mounted at a front end of the housing, and the plurality of LED lamp beads are mounted in the housing in an array and emit light towards the panel.

Furthermore, the battery box assembly comprises a battery box and a box cover. A plurality of rechargeable battery mounting grooves and a plurality of dry cell mounting grooves are formed in the battery box, the box cover is detachably clamped on the battery box, and a seal ring is disposed at a joint of the box cover and the battery box.

Furthermore, the photovoltaic solar panel assembly is provided with a base, a photovoltaic panel and a DC wire. The photovoltaic panel is movably connected to the base, the mount is provided with a DC socket electrically connected to the PCBA, and the DC wire is connected to the DC socket.

Furthermore, the safety induction lamp further comprises a hanging plate detachably clamped on the mount.

Furthermore, the hanging plate is provided with an elastic piece, the elastic piece is formed with a groove, and the mount is provided with a protruding block matched with the groove.

The invention has the following beneficial effects.

The safety induction lamp supplied with power by dry cells and lithium batteries comprises the mount, the connecting bracket assembly, the PCBA, and the lamp base assembly, the induction head assembly, the battery box assembly and the photovoltaic solar panel assembly that are connected to the PCBA, the battery box assembly is provided with dry cells and rechargeable batteries, and the PCBA is provided the power switch module, the illumination control module, the induction control module, the environment temperature monitoring control module, the remote control module, the Bluetooth module, the WIFI module and the link control module. The safety induction lamp is simple and reasonable in structure, and the PCBA controls the photovoltaic solar panel assembly to charge the rechargeable batteries and controls the rechargeable batteries or the dry cells to supply power to the lamp base assembly, so that the situation where the safety induction lamp cannot be used for illumination due to low power of the rechargeable batteries is avoided, and the safety induction lamp is convenient to use.

To make the aforementioned more comprehensible, several embodiments accompanied with drawings are described in detail as follows.

DESCRIPTION OF THE EMBODIMENTS

Figure 1:
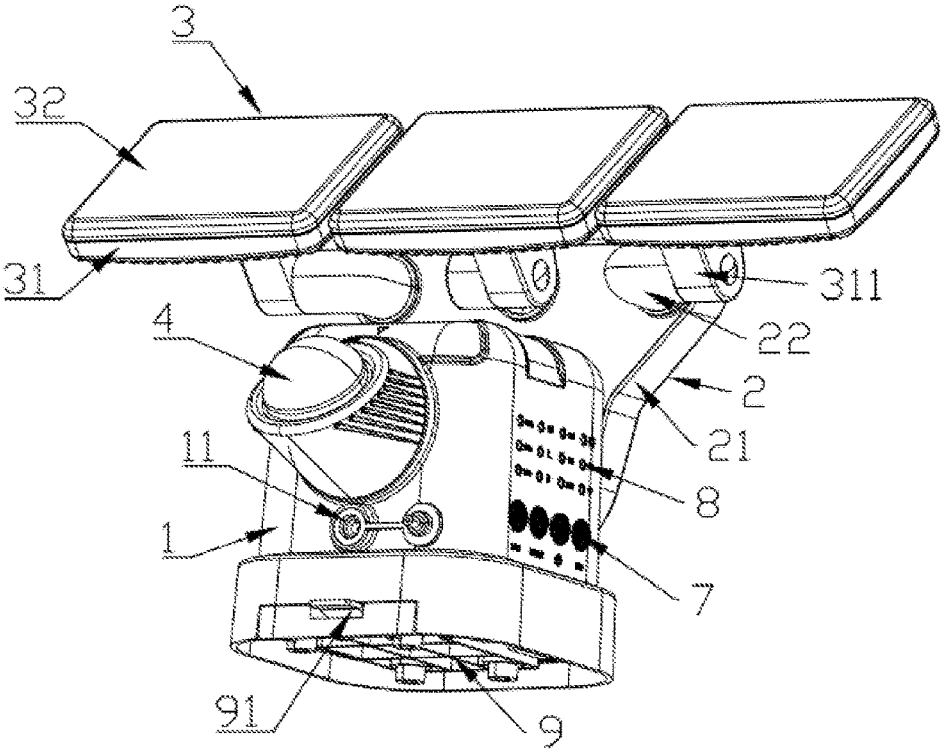
FIG. 1 is a structural diagram of the invention.

The invention will be further described below in conjunction with the accompanying drawings. As shown in FIG. 1-FIG. 6, this embodiment provides a safety induction lamp supplied with power by dry cells and lithium batteries, comprising a mount 1, a connecting bracket assembly 2, a PCBA, and a lamp base assembly 3, an induction head assembly 4, a battery box assembly 5 and a photovoltaic solar panel assembly 6 that are connected to the PCBA. The connecting bracket assembly 2 is connected to the mount 1 and the lamp base assembly 3, the induction head assembly 4 is rotatably disposed on an outer side of the mount 1, the battery box assembly 5 and the PCBA are mounted on an inner side of the mount 1, and the battery box assembly 5 is provided with dry cells and rechargeable batteries. The PCBA includes a power switch module for switching the dry cells or the lithium batteries for power supply, an illumination control module for controlling the illumination time and illumination brightness of the lamp base assembly, an induction control module for controlling the induction distance and induction temperature of the induction head assembly, an environment temperature monitoring control module for controlling the induction head assembly to detect the environment temperature, a remote control module to be connected to an external control, a Bluetooth module for controlling the lamp by means of a mobile phone front-end, a WIFI module for remotely controlling the lamp by means of a mobile phone APP, a link control module for link control of multiple safety induction lamps, and a control chip.

In this embodiment, the illumination and functions of the safety induction lamp are realized by triggering the detection function of the induction head assembly, the rechargeable batteries or the backup dry cells automatically selected to supply power to the safety induction lamp under the control of the PCBA, and the rechargeable batteries can be prevented from being over-charged or over-discharged under the control, monitoring and protection of the PCBA. When the voltage of the rechargeable batteries is too low, the backup dry cells start to supply power to the safety induction lamp, a photovoltaic solar panel is controlled to charge the rechargeable batteries until the voltage of the rechargeable batteries is greater than a low-voltage protection value of the batteries, and at this moment, the rechargeable batteries used for power supply to reduce a power output of the backup dry cells and prolong the service time of the backup dry cells. The rechargeable batteries are prevented from being over-charged or over-discharged, so that the service life of the rechargeable batteries is prolonged. The safety induction lamp is equivalently provided with two power supply systems, namely the rechargeable batteries and the dry cells, which are controlled by the PCBA to supply power alternately, so that the power supply is stable. Moreover, the illumination condition (such as the illumination time and the illumination brightness), the induction condition (such as the induction distance) and environmental monitoring (such as environmental brightness and brightness) can be controlled by means of the PCBA, and the remote control module is connected to a remote control to realize control; the Bluetooth module is used to control the lamp by means of a mobile phone front-end. The WIFI module is used to remotely control the lamp by means of a mobile phone APP. The link control module realizes interconnected control of different lamps, link control of multiple lamps by one lamp, or synchronous control over the functions of multiple lamps. The safety induction lamp is reasonable in design and high in practicability.

Referring to FIG. 1, on the basis of the above embodiment, the safety induction lamp further comprises functional switches 7 and functional indicators 8. The functional switches 7 and the functional indicators 8 are connected to the illumination control module and the induction control module respectively. Specifically, the functional switches 7 comprise an environmental brightness control switch, an induction distance control switch, an illumination time control switch, an illumination intensity switch and a test switch. In this embodiment, the functional switches 7 are electronic touch switches. When the safety induction lamp is used, the test switch is pressed, and then the illumination and induction can be flexibly controlled and set by means of the corresponding switches, such that using is convenient.

Specifically, the induction head assembly 4 is provided with a signal receiver connected to the PCBA. Through the arrangement of the signal receiver, on-off and function selection of the safety induction lamp can be realized by means of a remote control, and is convenient to use.

Figure 3:
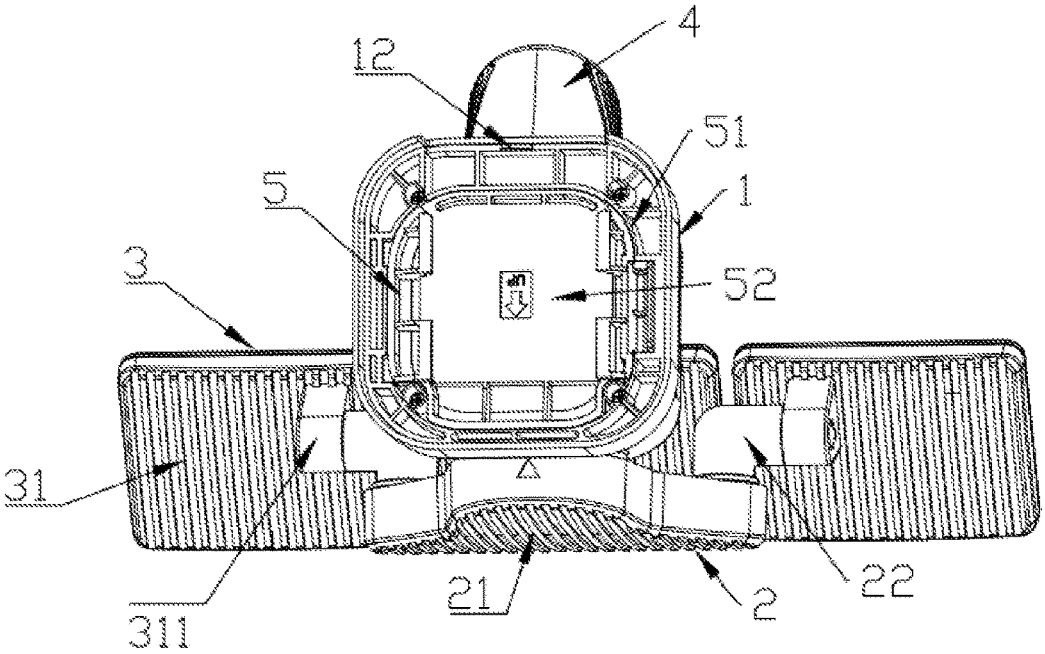
FIG. 3 is a structural view of the invention when the hanging plate is not assembled.
Figure 4:
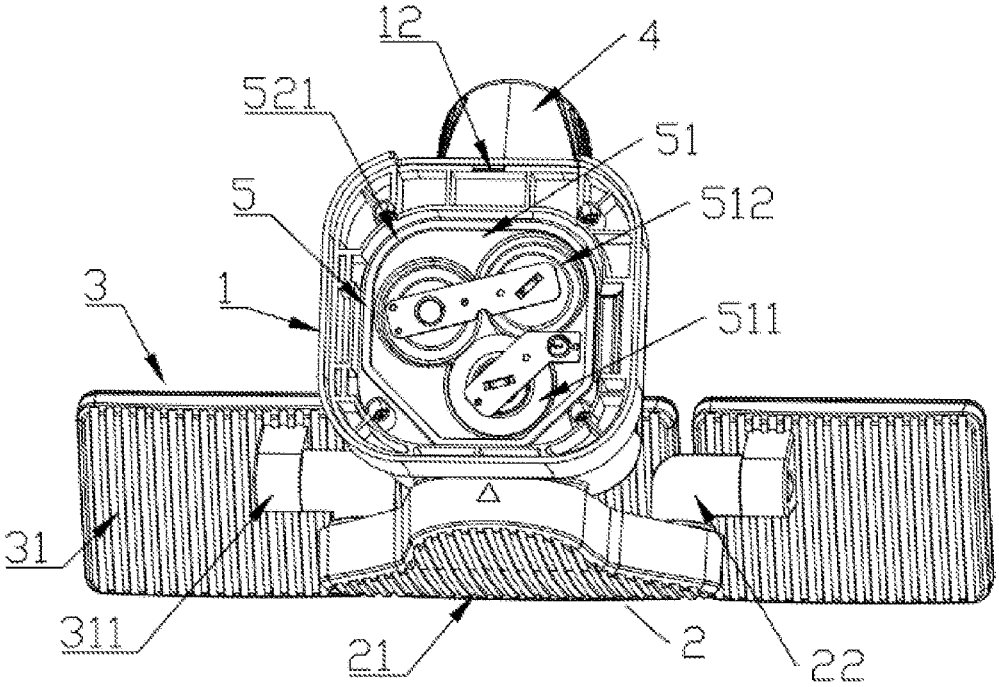
FIG. 4 is a structural view of FIG. 3 when a box cover of a battery box assembly is not assembled.
Figure 5:
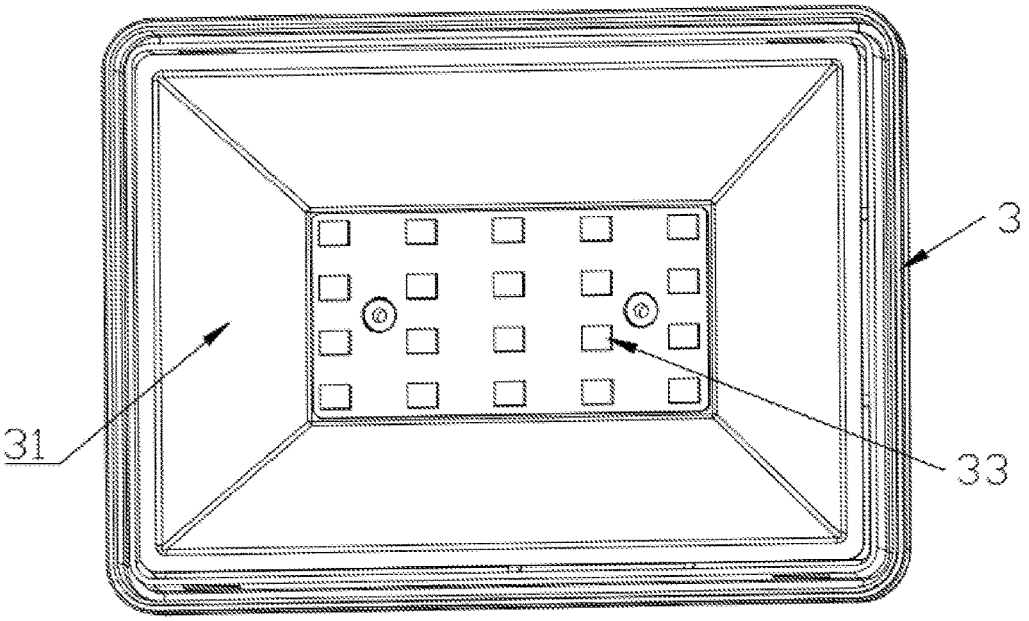
FIG. 5 is a connection structural diagram of a housing and LED lamp beads of a lamp base assembly of the invention.

Referring to FIG. 1, FIG. 3 and FIG. 4, the connecting bracket assembly 2 comprises a connecting plate 21 and a movable arm 22. The connecting plate 21 is rotatably connected to the mount 1, one end of the movable arm 22 is rotatably connected to the connecting plate 21, and the other end of the movable arm 22 is rotatably connected to the lamp base assembly 3. Specifically, the lamp base assembly 3 is provided with a housing 31, a panel 32 and a plurality of LED lamp beads 33. A connecting block 311 is disposed at a rear end of the housing 31 and is movably connected to the movable arm 22, the panel 32 is mounted at a front end of the housing 31, and the plurality of LED lamp beads 33 are mounted in the housing 21 in an array and emit light towards the panel 32. More specifically, in this embodiment, three lamp base assemblies 3 are arranged, three movable arms 22 are arranged correspondingly and are disposed on the connecting plate 21 at intervals, and by rotatably adjusting the position of the connecting plate 21 with respect to the mount 1, the positions of the movable arms 22 with respect to the connecting plate 21 and the positions of the lamp base assemblies 3 with respect to the movable arms 22, multi-angle wide-range illumination of the safety induction lamp can be realized, and the illumination effect is good. The lamp base assemblies 3 can also be rotatably adjusted to a minimum size to be stored, and using is convenient.

Referring to FIG. 3 and FIG. 4, the battery box assembly 5 comprises a battery box 51 and a box cover 52. A plurality of rechargeable battery mounting grooves 511 and a plurality of dry cell mounting grooves 512 are formed in the battery box 51, the box cover 52 is detachably clamped on the battery box 51, and a seal ring 521 is disposed at a joint of the box cover 52 and the battery box 51. In this way, batteries can be disassembled and assembled conveniently, and the seal ring 521 effectively ensures the water-proof performance of the safety induction lamp.

Figure 6:
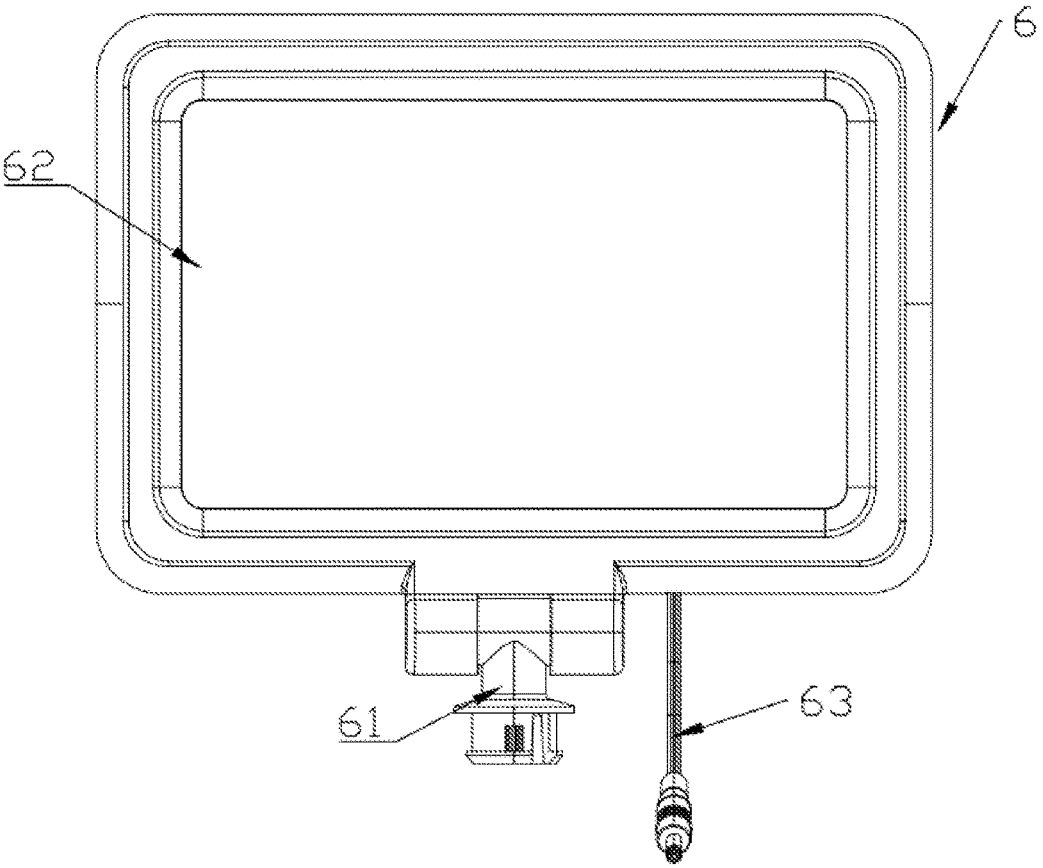
FIG. 6 is a structural view of a photovoltaic solar panel assembly of the invention.

Referring to FIG. 6, the photovoltaic solar panel assembly 6 is provided with a base 61, a photovoltaic panel 62 and a DC wire 63. The photovoltaic panel 62 is movably connected to the base 61, the mount 1 is provided with a DC socket 11 electrically connected to the PCBA, and the DC wire 63 is connected to the DC socket 11. When the safety induction lamp in this embodiment is used, the position of the photovoltaic panel 62 with respect to the base 61 can be adjusted to better collect sunlight, and the photovoltaic panel 62 can be electrically connected to the PCBA by electrically connecting the DC wire 63 to the DC socket 11 mounted on the mount 1 so as to be controlled by the PCBA to charge rechargeable batteries.

Figure 2:
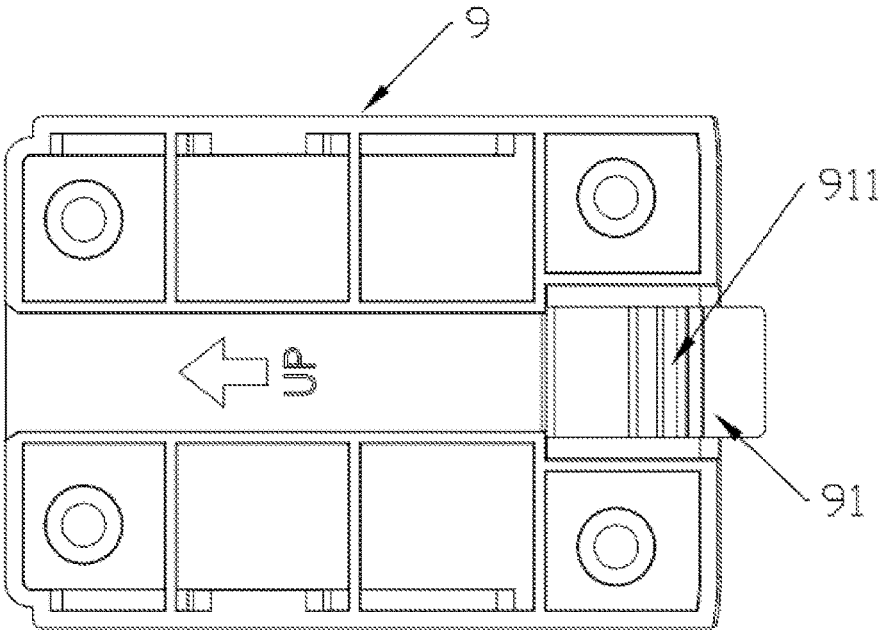
FIG. 2 is a structural view of a hanging plate of the invention.

Referring to FIG. 2, the safety induction lamp further comprises a hanging plate 9 detachably clamped on the mount 1. Specifically, the hanging plate 9 is provided with an elastic piece 91, the elastic piece 91 is formed with a groove 911, and the mount 1 is provided with a protruding block 12 matched with the groove 911. In this way, after the hanging plate 9 is assembled on an external assembly, the elastic piece 91 is pressed to clamp the mount 1 on the hanging plate 9, so that the whole safety induction lamp is mounted. The safety induction lamp is extremely easy to mount and use.

The above embodiments only illustrate several implementations of the invention, and are specifically described in detail. But, these embodiments cannot be construed as limiting the patent scope of the invention. It should be noted that those ordinarily skilled in the art can make different transformations and improvements without departing from the concept of the invention, and all these transformations and improvements should also fall within the protection scope of the invention. Thus, the protection scope of the patent of invention should be subject to the claims.

What is claimed is:

1. A safety induction lamp supplied with power by dry cells and lithium batteries, the safety induction lamp comprising a mount, a connecting bracket assembly, a printed circuit board assembly (PCBA), and a lamp base assembly, an induction head assembly, a battery box assembly and a photovoltaic solar panel assembly that are connected to the PCBA, wherein the battery box assembly is provided with dry cells and rechargeable batteries, and the PCBA includes a power switch module for switching the dry cells or the rechargeable batteries for power supply, an illumination control module for controlling an illumination time and illumination brightness of the lamp base assembly, an induction control module for controlling an induction distance and induction temperature of the induction head assembly, an environment temperature monitoring control module for controlling the induction head assembly to detect an environment temperature, a remote control module to be connected to an external control, a Bluetooth module for controlling the lamp by a mobile terminal front-end, a WIFI module for remotely controlling the lamp by a mobile phone application (App), a link control module for link control of multiple safety induction lamps, and a control chip.

2. The safety induction lamp supplied with power by dry cells and lithium batteries according to claim 1, the safety induction lamp further comprising functional switches and functional indicators, wherein the functional indicators and the functional switches are connected to the illumination control module and the induction control module, respectively.

3. The safety induction lamp supplied with power by dry cells and lithium batteries according to claim 2, wherein the functional switches comprise an environmental brightness control switch, an induction distance control switch, an illumination time control switch, an illumination intensity switch and a test switch.

4. The safety induction lamp supplied with power by dry cells and lithium batteries according to claim 1, wherein the induction head assembly is provided with a signal receiver connected to the PCBA.

5. The safety induction lamp supplied with power by dry cells and lithium batteries according to claim 1, wherein the connecting bracket assembly comprises a connecting plate and a movable arm, the connecting plate is rotatably connected to the mount, and the movable arm has an end rotatably connected to the connecting plate and another end rotatably connected to the lamp base assembly.

6. The safety induction lamp supplied with power by dry cells and lithium batteries according to claim 5, wherein the lamp base assembly is provided with a housing, a panel and a plurality of light-emitting diode (LED) lamp beads, a connecting block is disposed at a rear end of the housing and is movably connected to the movable arm, the panel is mounted at a front end of the housing, and the plurality of LED lamp beads are mounted in the housing in an array and emit light towards the panel.

7. The safety induction lamp supplied with power by dry cells and lithium batteries according to claim 1, wherein the battery box assembly comprises a battery box and a box cover, a plurality of rechargeable battery mounting grooves and a plurality of dry cell mounting grooves are formed in the battery box, the box cover is detachably clamped on the battery box, and a seal ring is disposed at a joint of the box cover and the battery box.

8. The safety induction lamp supplied with power by dry cells and lithium batteries according to claim 1, wherein the photovoltaic solar panel assembly is provided with a base, a photovoltaic panel and a direct current (DC) wire, the photovoltaic panel is movably connected to the base, the mount is provided with a direct current (DC) socket electrically connected to the PCBA, and the DC wire is connected to the DC socket.

9. The safety induction lamp supplied with power by dry cells and lithium batteries according to claim 1, the safety induction lamp further comprising a hanging plate detachably clamped on the mount.

10. The safety induction lamp supplied with power by dry cells and lithium batteries according to claim 9, wherein the hanging plate is provided with an elastic piece, the elastic piece is formed with a groove, and the mount is provided with a protruding block matched with the groove.

* * * * *